US010837076B2

(12) United States Patent
Saito et al.

(10) Patent No.: US 10,837,076 B2
(45) Date of Patent: Nov. 17, 2020

(54) STEEL SHEET FOR CANS AND METHOD FOR MANUFACTURING STEEL SHEET FOR CANS

(71) Applicant: JFE STEEL CORPORATION, Tokyo (JP)

(72) Inventors: Hayato Saito, Fukuyama (JP); Katsumi Kojima, Fukuyama (JP); Hiroki Nakamaru, Tokyo (JP)

(73) Assignee: JFE Steel Corporation, Tokyo (JP)

( * ) Notice: Subject to any disclaimer, the term of this patent is extended or adjusted under 35 U.S.C. 154(b) by 267 days.

(21) Appl. No.: 15/526,146

(22) PCT Filed: Oct. 13, 2015

(86) PCT No.: PCT/JP2015/005179

§ 371 (c)(1),
(2) Date: May 11, 2017

(87) PCT Pub. No.: WO2016/075866

PCT Pub. Date: May 19, 2016

(65) Prior Publication Data

US 2017/0314095 A1 Nov. 2, 2017

(30) Foreign Application Priority Data

Nov. 12, 2014 (JP) ..... 2014-229664

(51) Int. Cl.

| | |
|---|---|
| ***C21D 9/46*** | (2006.01) |
| ***C21D 8/02*** | (2006.01) |
| ***C22C 38/00*** | (2006.01) |
| ***C22C 38/02*** | (2006.01) |
| ***C22C 38/06*** | (2006.01) |
| ***C22C 38/38*** | (2006.01) |
| ***C22C 38/14*** | (2006.01) |
| ***C22C 38/12*** | (2006.01) |
| ***C22C 38/18*** | (2006.01) |
| ***C21D 8/04*** | (2006.01) |
| ***C22C 38/04*** | (2006.01) |
| ***C21D 9/48*** | (2006.01) |
| ***C21D 1/28*** | (2006.01) |
| ***C21D 6/00*** | (2006.01) |
| ***B21B 1/22*** | (2006.01) |
| ***B21B 1/02*** | (2006.01) |
| ***C22C 38/22*** | (2006.01) |
| ***C22C 38/28*** | (2006.01) |
| ***C22C 38/32*** | (2006.01) |

(Continued)

(52) U.S. Cl.

CPC ..... *C21D 9/46* (2013.01); *B21B 1/026* (2013.01); *B21B 1/22* (2013.01); *C21D 1/28* (2013.01); *C21D 6/002* (2013.01); *C21D 6/004* (2013.01); *C21D 6/005* (2013.01); *C21D 6/008* (2013.01); *C21D 8/0236* (2013.01); *C21D 8/0247* (2013.01); *C21D 8/0268* (2013.01); *C21D 8/0436* (2013.01); *C21D 8/0447* (2013.01); *C21D 8/0468* (2013.01); *C21D 9/48* (2013.01); *C22C 38/00* (2013.01); *C22C 38/001* (2013.01); *C22C 38/002* (2013.01); *C22C 38/02* (2013.01); *C22C 38/04* (2013.01); *C22C 38/06* (2013.01); *C22C 38/12* (2013.01); *C22C 38/14* (2013.01); *C22C 38/18* (2013.01); *C22C 38/22* (2013.01); *C22C 38/28* (2013.01); *C22C 38/32* (2013.01); *C22C 38/38* (2013.01); *C23G 1/00* (2013.01); *B21B 2001/028* (2013.01); *B21B 2001/221* (2013.01); *B65D 17/00* (2013.01); *B65D 85/00* (2013.01); *C21D 8/04* (2013.01); *C21D 9/56* (2013.01); *C21D 2201/05* (2013.01); *C21D 2211/001* (2013.01); *C21D 2211/005* (2013.01); *C21D 2211/008* (2013.01)

(58) Field of Classification Search

None

See application file for complete search history.

(56) References Cited

U.S. PATENT DOCUMENTS 6,221,180 B1 4/2001 Tosaka

FOREIGN PATENT DOCUMENTS

| | | | |
|---|---|---|---|
| CN | 1263568 | A | 8/2000 |
| CN | 101802236 | A | 8/2010 |

(Continued)

OTHER PUBLICATIONS

ASTM International. ASTM A623-11 Standard Specification for Tin Mill Products, General Requirements. West Conshohocken, PA; ASTM International, 2011. doi: (Year: 2011).*

Taiwanese Office Action for Taiwanese Application No. 104134539, dated May 13, 2016, including Concise Statement of Search Report, 5 pages.

(Continued)

*Primary Examiner* — Alexandra M Moore
*Assistant Examiner* — Adil A. Siddiqui
(74) *Attorney, Agent, or Firm* — RatnerPrestia

(57) ABSTRACT

A steel sheet for cans has a chemical composition containing, by mass %, C: 0.015% or more and 0.150% or less, Si: 0.04% or less, Mn: 1.0% or more and 2.0% or less, P: 0.025% or less, S: 0.015% or less, Al: 0.01% or more and 0.10% or less, N: 0.0005% or more and less than 0.0050%, Ti: 0.003% or more and 0.015% or less, B: 0.0010% or more and 0.0040% or less, and the balance being Fe and inevitable impurities. The steel sheet has a microstructure including a ferrite phase as a main phase and at least one of a martensite phase and a retained austenite phase as a second phase, the total area fraction of the second phase being 1.0% or more, and the sheet has a tensile strength of 480 MPa or more, a total elongation of 12% or more, and a yield elongation of 2.0% or less.

6 Claims, No Drawings

(51) Int. Cl.

| | |
|---|---|
| ***C23G 1/00*** | (2006.01) |
| *C21D 9/56* | (2006.01) |
| *B65D 17/00* | (2006.01) |
| *B65D 85/00* | (2006.01) |

(56) References Cited

FOREIGN PATENT DOCUMENTS

| | | | | | |
|---|---|---|---|---|---|
| CN | 101802236 | B | * | 5/2012 | ..... C22C 38/001 |
| CN | 103717770 | A | | 4/2014 | |
| EP | 0999288 | A1 | | 5/2000 | |
| JP | 04337049 | A | | 11/1992 | |
| JP | H07102323 | A | | 4/1995 | |
| JP | H08325670 | A | | 12/1996 | |
| JP | H11124654 | A | | 5/1999 | |
| JP | 2001089829 | A | | 4/2001 | |
| JP | 2007321207 | A | | 12/2007 | |
| JP | 2007321208 | A | | 12/2007 | |
| JP | 2009084687 | A | | 4/2009 | |
| JP | 2013224476 | A | * | 10/2013 | |
| JP | 2013224476 | A | | 10/2013 | |

OTHER PUBLICATIONS

Extended European Search Report for European Application No. 15859753.4, dated Aug. 21, 2017, 9 pages.

Chinese Office Action for Chinese Application No. 201580061458.0, dated Feb. 26, 2018 with Concise Statement of Relevance of Office Action, 7 pages.

International Search Report and Written Opinion for International Application PCT/JP2015/005179, dated Jan. 19, 2016—4 Pages.

* cited by examiner

STEEL SHEET FOR CANS AND METHOD FOR MANUFACTURING STEEL SHEET FOR CANS

CROSS REFERENCE TO RELATED APPLICATIONS

This is the U.S. National Phase application of PCT/JP2015/005179, filed Oct. 13, 2015, which claims priority to Japanese Patent Application No. 2014-229664, filed Nov. 12, 2014, the disclosures of each of these applications being incorporated herein by reference in their entireties for all purposes.

TECHNICAL FIELD OF THE INVENTION

The present invention relates to a steel sheet for cans which is suitable as a material for cans mainly used for food cans and beverage cans and a method for manufacturing the steel sheet.

BACKGROUND OF THE INVENTION

Nowadays, from the viewpoint of reducing environmental loads and cost, there is a demand for decreasing the amount of steel sheet used for food cans and beverage cans, and thus the thickness of a steel sheet is being reduced regardless of whether the steel sheet is used for two-piece cans or three-piece cans.

Moreover, in order to compensate for a decrease in the strength of can due to the reduction of the thickness, the can is often formed as a special-shaped can produced by subjecting its can body to bead forming or by forming a geometrical shape on the can body. In the case of two-piece special-shaped cans, a steel sheet is required to have higher formability than ever, because the can body is subjected to additional forming after having been subjected to working such as drawing and ironing in which comparatively intense work is performed.

On the other hand, in the case of a can bottom, which is subject to a low degree of working, there is only a small increase in the strength due to work hardening, and thus it is necessary that the strength of a steel sheet be increased when the thickness of the steel sheet is reduced. In particular, when the can bottom has a flat shape, that is, when the degree of work is very low, it is necessary that the strength of the steel sheet be increased to a higher level.

In addition, since the occurrence of stretcher strain (wrinkling) in a can-manufacturing process causes poor surface appearance, it is necessary that the yield elongation of a steel sheet be sufficiently small.

Generally, the formability of a steel sheet decreases with an increase in its strength. In response to such a problem, consideration has been given to utilizing a hard second phase in a steel sheet in order to realize a steel sheet having high strength and good formability.

Patent Literature 1 discloses a high-strength good-formability cold-rolled steel sheet for can making, the steel sheet having a chemical composition containing C: 0.15 wt. % or less, Si: 0.10 wt. % or less, Mn: 3.00 wt. % or less, Al: 0.150 wt. % or less, P: 0.100 wt. % or less, S: 0.010 wt. % or less, N: 0.0100 wt. % or less, and the balance being Fe and inevitable impurities, a steel sheet microstructure including a mixed microstructure composed of ferrite and martensite or bainite, a TS of 40 kgf/mm$^2$ or more, an El of 15% or more, and a BH of 5 kgf/mm$^2$ or more.

Patent Literature 2 discloses a high-strength steel sheet for can making used for a product having a thickness t of 0.1 mm to 0.5 mm, the steel sheet having a steel chemical composition containing, by mass %, C: 0.04% to 0.13%, Si: more than 0.01% to 0.03%, Mn: 0.1% to 0.6%, P: 0.02% or less, S: 0.02% or less, Al: 0.01% to 0.2%, N: 0.001% to 0.02%, and the balance being Fe and inevitable impurities, a steel sheet microstructure including a dual phase structure composed of a ferrite phase and a martensite phase, in which a main phase is the ferrite phase, in which the martensite phase fraction is 5% or more and less than 30%, and in which the martensite grain diameter d (μm) and the thickness t (mm) of the product satisfy relational expression (A) below, and a 30T-hardness of 60 or more.

$$1.0<(1-\mathrm{EXP}(-t*3.0))*4/d \qquad \text{relational expression (A)}$$

PATENT LITERATURE

PTL 1: Japanese Unexamined Patent Application Publication No. 4-337049

PTL 2: Japanese Unexamined Patent Application Publication No. 2009-84687

SUMMARY OF THE INVENTION

However, the conventional techniques described above have the problems described below.

In the case of the invention according to Patent Literature 1, since cold rolling is performed twice and annealing is performed twice in order to manufacture a steel sheet, there is an increase in energy cost. In addition, it is difficult to stably inhibit stretcher strain, that is, it is Difficult to achieve low yield elongation.

In the case of the invention according to Patent Literature 2, since it is necessary that rapid cooling be performed in an annealing process, an unevenness in temperature in a steel sheet tends to increase, which makes it difficult to stably achieve good formability. Moreover, there is a problem in that, since the Mn content is low, that is, 0.1% to 0.6%, it is not possible to sufficiently decrease yield elongation.

The present invention has been completed in view of the situation described above, and an object to be achieved by the present invention is to provide a steel sheet for cans having high strength and excellent formability and a method for manufacturing the steel sheet. In particular, an object to be achieved by the present invention is to provide a steel sheet for cans which can preferably be used in a forming process for two-piece special-shaped cans and a method for manufacturing the steel sheet.

The present inventors diligently conducted investigations in order to achieve the object described above. Specifically, the present inventors diligently conducted investigations in order to achieve both high strength which is required for a can bottom and excellent formability which is required for a can body. As a result, the present inventors found that it is possible to achieve the object described above by controlling chemical composition, steel sheet microstructure, tensile strength (hereinafter, also referred to as TS), total elongation, and yield elongation (hereinafter, also referred to as YP-EL) to be within specified ranges, resulting in the completion of the present invention. Moreover, the present inventors diligently conducted investigations regarding manufacturing conditions and found that it is preferable, in particular, to control annealing conditions and second cold rolling conditions to be within specified ranges in order to control microstructure. The subject matter of the present invention includes the following.

[1] A steel sheet for cans, the steel sheet having a chemical composition containing, by mass %, C: 0.015% or more and 0.150% or less, Si: 0.04% or less, Mn: 1.0% or more and 2.0% or less, P: 0.025% or less, S: 0.015% or less, Al: 0.01% or more and 0.10% or less, N: 0.0005% or more and less than 0.0050%, Ti: 0.003% or more and 0.015% or less, B: 0.0010% or more and 0.0040% or less, and the balance being Fe and inevitable impurities, a steel sheet microstructure including a ferrite phase as a main phase and at least one of a martensite phase and a retained austenite phase as a second phase, the total area fraction of the second phase being 1.0% or more, a tensile strength of 480 MPa or more, a total elongation of 12% or more, and a yield elongation of 2.0% or less.

[2] The steel sheet for cans according to item [1], in which the chemical composition further contains one or both of Cr: 0.03% or more and 0.30% or less and Mo: 0.01% or more and 0.10% or less.

[3] A method for manufacturing a steel sheet for cans, the method including heating a slab having the chemical composition according to item [1] or [2] to a heating temperature of 1130° C. or higher, hot-rolling the heated slab with a finishing temperature of 820° C. or higher and 930° C. or lower, then coiling the hot-rolled steel sheet at a coiling temperature of 640° C. or lower, pickling the coiled steel sheet, performing primary cold rolling on the pickled steel sheet with a rolling reduction of 85% or more, performing continuous annealing on the cold-rolled steel sheet at an annealing temperature of 720° C. or higher and 780° C. or lower, and performing secondary cold rolling with a rolling reduction of 1.0% or more and 10% or less.

[4] The method for manufacturing a steel sheet for cans according to item [3], the method further including, after the continuous annealing has been performed, cooling the annealed steel sheet from the annealing temperature to a temperature of 400° C. at a cooling rate of 2° C./s or more and less than 70° C./s and then performing the secondary cold rolling.

The steel sheet for cans according to the present invention has high strength and excellent formability.

Moreover, by using the steel sheet for cans according to the present invention, it is possible to easily manufacture two-piece special-shaped cans.

According to the present invention, since it is possible to realize an additional reduction of the thickness of a steel sheet which is used for, for example, food cans and beverage cans, it is possible to realize resource saving and cost reduction, which has a marked effect on the industry.

DETAILED DESCRIPTION OF EMBODIMENTS OF THE INVENTION

Hereafter, the present invention will be described in detail. Here, the present invention is not limited to the embodiments described below.

The steel sheet for cans according to an embodiment of the present invention has a chemical composition containing, by mass %, C: 0.015% or more and 0.150% or less, Si: 0.04% or less, Mn: 1.0% or more and 2.0% or less, P: 0.025% or less, S: 0.015% or less, Al: 0.01% or more and 0.10% or less, N: 0.0005% or more and less than 0.0050%, Ti: 0.003% or more and 0.015% or less, B: 0.0010% or more and 0.0040% or less, and the balance being Fe and inevitable impurities, a steel sheet microstructure including a ferrite phase as a main phase and at least one of a martensite phase and a retained austenite phase as a second phase, in which the total area fraction of the second phase is 1.0% or more, a tensile strength of 480 MPa or more, a total elongation of 12% or more, and a yield elongation of 2.0% or less. In addition, the method preferable for manufacturing a steel sheet for cans according to the present invention includes heating a slab having the chemical composition described above to a heating temperature of 1130° C. or higher, hot-rolling the heated slab with a finishing temperature of 820° C. or higher and 930° C. or lower, then coiling the hot-rolled steel sheet at a coiling temperature of 640° C. or lower, pickling the coiled steel sheet, performing primary cold rolling on the pickled steel sheet with a rolling reduction of 85% or more, performing continuous annealing on the cold-rolled steel sheet at an annealing temperature of 720° C. or higher and 780° C. or lower, and performing secondary cold rolling with a rolling reduction of 1.0% or more and 10% or less.

Hereafter, the chemical composition, steel sheet microstructure, steel sheet properties, and manufacturing method of the steel sheet for cans according to the present invention will be described in sequence. First, the chemical composition of the steel sheet for cans according to embodiments of the present invention will be described. In the description of the chemical composition, the contents of the respective constituent chemical elements are expressed in units of mass %.

C: 0.015% or more and 0.150% or less

C is a chemical element which is important for forming a second phase in a steel sheet microstructure and increasing tensile strength, and, by controlling the C content to be 0.015% or more, it is possible to achieve a second phase fraction of 1.0% or more and a tensile strength of 480 MPa or more. Moreover, by forming the second phase, it is possible to decrease YP-EL to 2.0% or less. Since the second phase fraction increases with an increase in C content and thus contributes to an increase in the strength, it is preferable that the C content be 0.030% or more. On the other hand, when the C content is more than 0.150%, since there is a decrease in total elongation to less than 12%, and since there is an increase in yield elongation, there is a decrease in formability. Therefore, it is necessary that the upper limit of the C content be 0.150%. It is preferable that the C content be 0.080% or less, or more preferably 0.060% or less, from the viewpoint of formability.

Si: 0.04% or less

Since there is a decrease in surface treatment capability due to the surface concentration of Si when the Si content is large, resulting in a decrease in corrosion resistance, it is necessary that the Si content be 0.04% or less, or preferably 0.03% or less.

Mn: 1.0% or more and 2.0% or less

Mn is a chemical element which is important for forming a second phase and increasing strength and which is effective for decreasing yield elongation by decreasing the amount of a solid solution C in an annealing process. In order to realize such effects, it is necessary that the Mn content be 1.0% or more. It is preferable that the Mn content be 1.5% or more, or more preferably 1.6% or more, in order to stably form a second phase. Since there is a decrease in total elongation due to center segregation markedly occurring when the Mn content is more than 2.0%, the Mn content is set to be 2.0% or less.

P: 0.025% or less

When the P content is large, there is a decrease in formability due to an excessive increase in hardness and due to center segregation, and there is a decrease in corrosion resistance. Therefore, the upper limit of the P content is set to be 0.025%, or preferably 0.020% or less. Since P increases hardenability and contributes to the formation of a second phase, it is preferable that the P content be 0.010% or more.

S: 0.015% or less

S decreases hot rolling capability by forming sulfides in steel. Therefore, the S content is set to be 0.015% or less, or preferably 0.012% or less.

Al: 0.01% or more and 0.10% or less

Al is effective as a deoxidizing chemical element, and it is necessary that the Al content be 0.01% or more in order to realize such an effect. Since a large amount of alumina is generated and retained in a steel sheet when the Al content is excessively large, resulting in a decrease in formability, it is necessary that the Al content be 0.10% or less, or preferably 0.08% or less.

N: 0.0005% or more and less than 0.0050%

Since there is a decrease in formability due to an increase in yield elongation when N exists in the form of a solid solution N, it is necessary that the N content be less than 0.0050%, preferably 0.0040% or less, or more preferably 0.0030% or less. It is even more preferable to put a limitation on the content of a solid solution N besides the total content of N described above and to limit the content of a solid solution N to less than 0.001%. It is possible to measure the content of a solid solution N by extracting the content of N in the form of nitrides, which is determined by performing extraction analysis using 10%-Br-methanol, from the total content of N. On the other hand, since controlling the total content of N to be stably less than 0.0005% is difficult and increases manufacturing cost, the lower limit of the N content is set to be 0.0005%.

Ti: 0.003% or more and 0.015% or less

Ti is effective for decreasing YP-EL by fixing N in the form of TiN. In addition, since Ti inhibits the formation of BN by forming TiN more readily than BN, resulting in a sufficient amount of solid solution B being saved, Ti effectively contributes to the formation of a second phase. Therefore, it is necessary that the Ti content be 0.003% or more, or preferably 0.005% or more. In the case where the Ti content is more than 0.015%, there is a decrease in the area fraction of a second phase as a result of C being fixed in the form of TiC, and, since sufficient recrystallization does not occur when annealing is performed due to a rise in the recrystallization temperature of a ferrite phase, there is a decrease in total elongation. Therefore, it is necessary that the Ti content be 0.015% or less.

B: 0.0010% or more and 0.0040% or less

Since B is effective for decreasing yield elongation by decreasing the amount of solid solution N as a result of combining with N to form BN, and since B which exists in the form of a solid solution B contributes to the formation of a second phase by increasing hardenability, it is necessary that the B content be 0.0010% or more. When the B content is excessively large, the effects described above become saturated, there is a decrease in total elongation, and there is a decrease in formability due to a deterioration in anisotropy. Therefore, it is necessary that the upper limit of the B content be 0.0040%.

It is preferable that one or both of Cr: 0.03% or more and 0.30% or less and Mo: 0.01% or more and 0.10% or less be added to the steel sheet for cans in addition to the chemical elements described above.

Cr: 0.03% or more and 0.30% or less

Cr contributes to the formation of a second phase by increasing hardenability and is effective for increasing strength and for decreasing YP-EL. Therefore, it is preferable that the Cr content be 0.03% or more. When the Cr content is more than 0.30%, such effects become saturated, and there may be a decrease in corrosion resistance. Therefore, it is preferable that the Cr content be 0.30% or less.

Mo: 0.01% or more and 0.10% or less

Mo contributes to the formation of a second phase by increasing hardenability and is effective for increasing strength and for decreasing YP-EL. Therefore, it is preferable that the Mo content be 0.01% or more. In the case where the Mo content is more than 0.10%, such effects become saturated, and there may be a decrease in total elongation as a result of recrystallization being inhibited when annealing is performed due to a rise in the recrystallization temperature of a ferrite phase. Therefore, it is preferable that the Mo content be 0.10% or less.

The remainder of the chemical composition of the steel sheet for cans is Fe and inevitable impurities.

Hereafter, the steel sheet microstructure of the steel sheet for cans according to embodiments of the present invention will be described.

Including ferrite phase as main phase

The microstructure of the steel sheet for cans according to embodiments of the present invention includes a ferrite phase as a main phase. It is preferable that the area fraction of a ferrite phase be 80% or more, more preferably 90% or more, or even more preferably 95% or more, from the viewpoint of formability.

Including at least one of martensite phase and retained austenite phase as second phase, in which the total area fraction of second phase is 1.0% or more The microstructure of the steel sheet for cans according to embodiments of the present invention includes a ferrite phase as a main phase and at least one of a martensite phase and a retained austenite phase as a second phase. The area fraction of the second phase of the steel sheet for cans according to embodiments of the present invention is 1.0% or more. By controlling the area fraction of the second phase to be 1.0% or more, it is possible to realize an increase in strength to a tensile strength of 480 MPa or more and a decrease in yield elongation to a yield elongation of 2.0% or less. It is preferable that the area fraction of the second phase be 2.0% or more. Although there is no particular limitation on the upper limit of the area fraction of the second phase, since there is a risk of a decrease in formability when the area fraction of the second phase is excessively large, it is preferable that the area fraction of the second phase be 20% or less, or more preferably 10% or less.

The steel sheet for cans according to the present invention may have a steel sheet microstructure including a ferrite phase, a martensite phase, and a retained austenite phase. On the other hand, although other phases such as cementite and a bainite phase, which are different from a ferrite phase, a martensite phase, and a retained austenite phase, may be included, the area fraction of such other phases is smaller than that of the second phase. For example, it is preferable that the area fraction of such other phases be less than 1.0% in total.

In the present invention, by taking a sample so that a vertical cross section parallel to the rolling direction of a steel sheet is observed, by embedding the sample in a resin, by polishing the sample, by then etching the sample with nital in order to expose the microstructure, by then taking a photograph of the steel sheet microstructure by using a scanning electron microscope, and by performing image processing, the area fractions of the constituent phases of the steel sheet microstructures such as a ferrite phase and the second phase (sum of the area fractions of a martensite phase and a retained austenite phase) are determined.

Hereafter, the steel sheet properties of the steel sheet for cans according to embodiments of the present invention will be described.

Tensile strength: 480 MPa or more, total elongation: 12% or more, and yield elongation: 2.0% or less It is necessary that the tensile strength of a steel sheet be 480 MPa or more, or preferably 490 MPa or more, in order to achieve sufficient strength of a can bottom. It is necessary that the total elongation be 12% or more, or preferably 15% or more, in order to achieve sufficient formability of a can body with which it is possible to perform, for example, bead forming in addition to drawing and ironing. It is necessary that the yield elongation be 2.0% or less, or preferably 1.0% or less, in order to prevent stretcher strain from occurring in a can-manufacturing process.

In the present invention, tensile strength, total elongation, and yield elongation are evaluated in accordance with JIS Z 2241 by taking a JIS No. 5 tensile test piece parallel to the rolling direction.

Although there is no particular limitation on the thickness of the steel sheet for cans according to the present invention, it is preferable that the thickness be 0.40 mm or less. Since it is possible to decrease the thickness of the steel sheet for cans according to the present invention to an ultra-thin level, it is more preferable that the thickness be 0.10 mm to 0.20 mm from the viewpoint of resource saving and cost reduction.

Hereafter, the method for manufacturing the steel sheet for cans according to embodiments of the present invention will be described. Although there is no particular limitation on the method used for manufacturing the steel sheet for cans according to the present invention, it is preferable that the steel sheet for cans be manufactured under the conditions described below. Here, for example, a plating process in which Sn plating, Ni plating, Cr plating, or the like is performed, a chemical-conversion-treatment process, or a resin-film-coating process such as one forming a laminate film may be performed appropriately.

Heating temperature: 1130° C. or higher

When a slab heating temperature before hot rolling is performed is excessively low, some of TiN remains undissolved, which may increase the risk of the formation of TiN having a large grain diameter which decreases formability. Therefore, the heating temperature is set to be 1130° C. or higher, or preferably 1150° C. or higher. There is no particular limitation on the upper limit of the heating temperature. However, when the slab heating temperature is excessively high, since an excessive amount of scale is generated, there is a risk of defects occurring on the surface of a product. Therefore, it is preferable that the upper limit of the heating temperature be 1260° C.

Finishing temperature of hot rolling: 820° C. or higher and 930° C. or lower

When the finishing temperature of hot rolling is higher than 930° C., since the generation of scale is promoted, there may be a decrease in surface appearance quality. Therefore, the upper limit of the finishing delivery temperature of hot rolling is set to be 930° C. When the finishing delivery temperature of hot rolling is lower than 820° C., since there is an increase in tensile property anisotropy, there may be a decrease in formability. Therefore, the lower limit of the finishing delivery temperature of hot rolling is set to be 820° C., or preferably 860° C.

Coiling temperature: 640° C. or lower

When the coiling temperature is higher than 640° C., carbides having a large grain diameter are formed in a hot-rolled steel sheet, and thus the formation of a second phase is inhibited due to the carbides having a large grain diameter remaining undissolved when annealing is performed, which may increase the risk of a decrease in tensile strength and an increase in YP-EL. Therefore, the coiling temperature is set to be 640° C. or lower. It is preferable that the coiling temperature be 600° C. or lower, or more preferably 550° C. or lower, in order to finely disperse carbides in a steel sheet. Although there is no particular limitation on the lower limit of the coiling temperature, it is preferable that the coiling temperature be 400° C. or higher, because when the coiling temperature is excessively low, there is an excessive increase in the hardness of a hot-rolled steel sheet and there is a risk of a cold rolling operation being disturbed.

There is no particular limitation on the conditions used for performing pickling as long as the surface scale of a steel sheet is removed. Pickling may be performed by using a commonly used method.

Rolling reduction of primary cold rolling: 85% or more

Since dislocations are formed by performing cold rolling, austenite transformation is promoted when annealing is performed, which results in the effect of promoting the formation of a second phase being realized. In order to realize such an effect, the rolling reduction of primary cold rolling is set to be 85% or more. In addition, by increasing the rolling reduction of primary cold rolling, there is a decrease in the grain diameter of a ferrite phase and there is also a decrease in the grain diameter of a second phase, and thus it is possible to improve the balance between tensile strength and formability. In the case where the rolling reduction of primary cold rolling is excessively large, there is an increase in tensile property anisotropy, and thus there may be a decrease in formability. Therefore, it is preferable that the rolling reduction of primary cold rolling be 93% or less.

Annealing Conditions

Annealing temperature: 720° C. or higher and 780° C. or lower

Forming a second phase in an annealing process is important for achieving high tensile strength, high total elongation, and low YP-EL. Stabilizing an austenite phase in a temperature range for forming a dual phase composed of ferrite and austenite is important for forming a second phase, and it is possible to form a second phase by performing annealing on a steel sheet at a temperature of 720° C. or higher and 780° C. or lower. Since it is necessary to sufficiently recrystallize a ferrite phase in an annealing process in order to achieve satisfactory formability, the annealing temperature is set to be 720° C. or higher. On the other hand, when the annealing temperature is excessively high, there is an excessive increase in ferrite grain diameter. Therefore, the annealing temperature is set to be 780° C. or lower. It is preferable that a continuous annealing method be used from the viewpoint of uniform material properties.

Although there is no particular limitation on an annealing time, it is preferable that the annealing time be 10 seconds or more and 60 seconds or less.

Cooling rate from annealing temperature to temperature of 400° C.:2° C./s or more and less than 70° C./s It is preferable that the cooling rate after annealing has been performed be controlled in order to stably form a second phase, and a second phase tends to be formed in an amount of 1.0% or more in terms of area fraction by controlling the cooling rate to be 2° C./s or more. When the cooling rate is excessively increased, it is not possible to stably achieve high total elongation due to an irregularity in cooling in a steel sheet, and there is a risk in that it is difficult to efficiently manufacture a steel sheet due to unstable threading of coils. Therefore, it is preferable that the cooling rate from the annealing temperature to a temperature of 400° C. be less than 70° C./s.

Rolling reduction of secondary cold rolling (DR): 1.0% or more and 10% or less

There is an increase in strength by performing secondary cold rolling on a steel sheet after annealing has been performed, and secondary cold rolling is effective for decreasing the yield elongation of a steel sheet. In order to realize such effects, the rolling reduction of secondary cold rolling is set to be 1.0% or more. When the rolling reduction of secondary cold rolling is excessively high, there is a decrease in formability. Therefore, the rolling reduction of secondary cold rolling is set to be 10% or less. It is preferable that the rolling reduction of secondary cold rolling be 4% or less, in particular, in the case where good formability is required.

EXAMPLES

Hereafter, examples of the present invention will be described. The technical scope of the present invention is not limited to the examples described below.

By preparing molten steels having chemical compositions containing the constituent chemical elements of steel codes A through V given in Table 1 and the balance being Fe and inevitable impurities, steel slabs were obtained. Under the conditions given in Table 2, by heating the obtained steel scale, by then performing hot-rolling, by coiling the hot-rolled steel sheets, by performing pickling in order to remove scale, by then performing primary cold rolling, by performing annealing by using a continuous annealing furnace at the annealing temperatures given in Table 2 for 15 seconds, by cooling the annealed steel sheets to a temperature of 400° C. at cooling rates given in Table 2, by performing cooling at a cooling rate of 20° C./s from a temperature of 400° C. to room temperature, and by performing secondary cold rolling with the rolling reductions given in Table 2, steel sheets (steel codes 1 through 33) having a thickness of 0.16 mm to 0.22 mm were obtained. After performing chromium (tin-free) plating on the steel sheets as a surface treatment, laminated steel sheets, which were coated with organic films, were obtained.

Evaluation of Tensile Strength, Total Elongation, and Yield Elongation

By removing organic film from the laminated steel sheet described above with concentrated sulfuric acid, and by then taking a JIS No. 5 tensile test piece parallel to the rolling direction, tensile strength, total elongation, and yield elongation were evaluated in accordance with JIS Z 2241. Here, although the organic film was removed in order to determine the thickness, the plating layer was not removed. This is because the plating layer was thin and within the error range of thickness determination, and thus there was almost no influence on the determined tensile strength even if the plating layer was not removed. Here, tensile strength, total elongation, and yield elongation may be evaluated after all or part of the plating layer has been removed. The evaluation results are given in Table 3.

Determination Results of Area Fractions of Steel Sheet Microstructure

By taking a sample so that a vertical cross section parallel to the rolling direction of a steel sheet was observed, by embedding the sample in a resin, by polishing the sample, by then etching the sample with nital in order to expose the microstructure, by then taking a photograph of the steel sheet microstructure by using a scanning electron microscope, and by performing image processing, the area fractions of a ferrite phase and the second phase (sum of the area fractions of a martensite phase and a retained austenite phase) were determined. The determination results are given in Table 3.

Determination of Amount of Solid Solution N

By removing the organic film and the plating layer from the steel sheet with concentrated sulfuric acid, and by then extracting the content of N in the form of nitrides, which was determined by performing extractive analysis using 10%-Br-methanol, from the total content of N, the content of a solid solution N was determined. The determination results are given in Table 3.

Evaluation of Formability

In order to evaluate formability, by cutting a circle (size: 140 mmϕ) out of the laminated steel sheet described above, by then performing, deep drawing, ironing and so on in order to make a can having a bottom and a circular cylindrical form (size: 50 mmϕ×100 mmH), by then performing bead forming on five positions in total in the circumferential direction of the can, that is, on the central position in the height direction of the can body, positions located 10 mm higher and lower than the central position in the height direction, and positions located 20 mm higher and lower than the central position in the height direction, a can having a can body similar to that of a two-piece can used as a beverage can was obtained. Evaluation was carried out by performing a visual test on the basis of the criteria described below. The evaluation results are given in Table 3.

Criteria

A case where fracturing did not occur in the can body at the time of can making and where stretcher strain was not observed was judged as ⊙, a case where fracturing did not occur in the can body and where slight stretcher strain which caused no problem in a practical use was observed was judged as ○, and a case where fracturing occurred in the can barrel or where marked stretcher strain was observed was judged as ×.

TABLE 1

Unit: mass %

| Steel Code | C | Si | Mn | P | S | Al | N | Ti | B | Cr | Mo | Note |
|---|---|---|---|---|---|---|---|---|---|---|---|---|
| A | 0.030 | 0.01 | 1.70 | 0.020 | 0.009 | 0.05 | 0.0030 | 0.006 | 0.0021 | — | — | Example |
| B | 0.040 | 0.02 | 1.70 | 0.018 | 0.010 | 0.04 | 0.0028 | 0.008 | 0.0025 | 0.10 | — | Example |
| C | 0.015 | 0.01 | 1.80 | 0.020 | 0.008 | 0.07 | 0.0025 | 0.009 | 0.0010 | — | — | Example |
| D | 0.080 | 0.02 | 1.50 | 0.015 | 0.010 | 0.07 | 0.0022 | 0.006 | 0.0031 | 0.05 | — | Example |
| E | 0.028 | 0.03 | 1.20 | 0.015 | 0.009 | 0.05 | 0.0035 | 0.012 | 0.0036 | — | 0.10 | Example |
| F | 0.050 | 0.01 | 1.95 | 0.010 | 0.006 | 0.08 | 0.0026 | 0.003 | 0.0031 | — | 0.02 | Example |
| G | 0.040 | 0.01 | 1.65 | 0.016 | 0.009 | 0.01 | 0.0030 | 0.013 | 0.0018 | 0.30 | — | Example |
| H | 0.060 | 0.02 | 1.60 | 0.010 | 0.008 | 0.06 | 0.0025 | 0.006 | 0.0020 | 0.08 | 0.03 | Example |
| I | 0.010 | 0.02 | 1.55 | 0.014 | 0.008 | 0.06 | 0.0036 | 0.010 | 0.0016 | — | — | Comparative Example |
| J | 0.035 | 0.02 | 0.50 | 0.016 | 0.011 | 0.05 | 0.0026 | 0.006 | 0.0020 | 0.15 | — | Comparative Example |
| K | 0.035 | 0.02 | 2.30 | 0.016 | 0.008 | 0.06 | 0.0040 | 0.007 | 0.0023 | — | — | Comparative Example |
| L | 0.060 | 0.01 | 1.70 | 0.015 | 0.008 | 0.04 | 0.0031 | 0.001 | 0.0015 | — | — | Comparative Example |
| M | 0.017 | 0.01 | 1.50 | 0.015 | 0.010 | 0.04 | 0.0020 | 0.020 | 0.0014 | — | — | Comparative Example |
| N | 0.054 | 0.01 | 1.70 | 0.015 | 0.010 | 0.06 | 0.0036 | 0.008 | 0.0046 | — | — | Comparative Example |
| O | 0.041 | 0.01 | 1.62 | 0.012 | 0.008 | 0.06 | 0.0029 | 0.008 | 0.0006 | — | — | Comparative Example |
| P | 0.035 | 0.02 | 0.80 | 0.020 | 0.009 | 0.05 | 0.0023 | 0.010 | 0.0024 | — | — | Comparative Example |
| Q | 0.026 | 0.01 | 1.60 | 0.010 | 0.009 | 0.05 | 0.0064 | 0.007 | 0.0018 | — | — | Comparative Example |
| R | 0.150 | 0.01 | 1.70 | 0.015 | 0.011 | 0.04 | 0.0026 | 0.007 | 0.0021 | — | — | Example |
| S | 0.136 | 0.01 | 1.60 | 0.019 | 0.011 | 0.04 | 0.0031 | 0.010 | 0.0026 | 0.07 | — | Example |
| T | 0.105 | 0.01 | 1.95 | 0.017 | 0.012 | 0.05 | 0.0018 | 0.008 | 0.0018 | — | 0.05 | Example |
| U | 0.129 | 0.01 | 1.70 | 0.016 | 0.011 | 0.06 | 0.0029 | 0.007 | 0.0023 | — | — | Example |
| V | 0.171 | 0.01 | 1.80 | 0.016 | 0.008 | 0.03 | 0.0031 | 0.009 | 0.0020 | — | — | Comparative Example |

TABLE 2

| Steel Sheet Code | Steel Code | Heating Temperature ° C. | Finishing Temperature of Hot Rolling ° C. | Coiling Temperature ° C. | Rolling Reduction of Primary Cold Rolling % | Annealing Temperature ° C. | Cooling Rate to 400° C. ° C./s | Rolling Reduction of Secondary Cold Rolling % | Thickness mm | Note |
|---|---|---|---|---|---|---|---|---|---|---|
| No1 | A | 1230 | 860 | 530 | 90 | 750 | 6 | 1.8 | 0.18 | Example |
| No2 | B | 1230 | 860 | 530 | 91 | 750 | 6 | 1.4 | 0.18 | Example |
| No3 | C | 1250 | 850 | 550 | 89 | 780 | 6 | 10.0 | 0.20 | Example |
| No4 | D | 1200 | 890 | 560 | 89 | 720 | 5 | 5.0 | 0.17 | Example |
| No5 | E | 1260 | 930 | 550 | 89 | 760 | 5 | 3.0 | 0.18 | Example |
| No6 | F | 1250 | 820 | 530 | 91 | 730 | 5 | 4.0 | 0.16 | Example |
| No7 | G | 1250 | 870 | 600 | 91 | 750 | 5 | 4.0 | 0.16 | Example |
| No8 | H | 1240 | 880 | 530 | 90 | 770 | 2 | 2.0 | 0.18 | Example |
| No9 | I | 1250 | 870 | 550 | 91 | 760 | 5 | 2.0 | 0.18 | Comparative Example |
| No10 | J | 1250 | 870 | 550 | 91 | 760 | 5 | 2.0 | 0.18 | Comparative Example |
| No11 | K | 1250 | 870 | 550 | 91 | 760 | 5 | 2.0 | 0.18 | Comparative Example |
| No12 | L | 1250 | 870 | 550 | 91 | 760 | 5 | 2.0 | 0.18 | Comparative Example |
| No13 | M | 1250 | 870 | 550 | 91 | 760 | 5 | 2.0 | 0.18 | Comparative Example |
| No14 | N | 1250 | 870 | 550 | 91 | 760 | 5 | 2.0 | 0.18 | Comparative Example |
| No15 | O | 1250 | 870 | 550 | 91 | 760 | 5 | 2.0 | 0.18 | Comparative Example |
| No16 | A | 1250 | 870 | 550 | 90 | 760 | 50 | 1.8 | 0.22 | Example |
| No17 | A | 1250 | 870 | 550 | 90 | 760 | 65 | 1.8 | 0.20 | Example |
| No18 | A | 1250 | 870 | 550 | 90 | 760 | 73 | 1.8 | 0.18 | Example |
| No19 | A | 1250 | 870 | 550 | 90 | 760 | 1 | 1.8 | 0.18 | Example |
| No20 | A | 1250 | 870 | 550 | 90 | 670 | 6 | 2.0 | 0.20 | Comparative Example |
| No21 | A | 1250 | 870 | 550 | 90 | 830 | 6 | 3.0 | 0.20 | Comparative Example |
| No22 | A | 1250 | 870 | 550 | 90 | 800 | 100 | 2.0 | 0.20 | Comparative Example |
| No23 | A | 1250 | 870 | 550 | 90 | 760 | 6 | 15.0 | 0.20 | Comparative Example |
| No24 | A | 1250 | 870 | 550 | 90 | 760 | 6 | 0.5 | 0.20 | Comparative Example |
| No25 | A | 1250 | 870 | 680 | 90 | 760 | 5 | 2.0 | 0.20 | Comparative Example |
| No26 | A | 1250 | 870 | 400 | 90 | 760 | 5 | 2.0 | 0.20 | Example |
| No27 | P | 1240 | 880 | 550 | 89 | 770 | 5 | 3.0 | 0.20 | Comparative Example |
| No28 | Q | 1250 | 880 | 550 | 90 | 760 | 6 | 4.0 | 0.19 | Comparative Example |
| No29 | R | 1250 | 870 | 540 | 90 | 750 | 6 | 2.0 | 0.18 | Example |
| No30 | S | 1260 | 865 | 550 | 90 | 750 | 6 | 2.0 | 0.18 | Example |
| No31 | T | 1230 | 875 | 550 | 90 | 740 | 6 | 2.0 | 0.18 | Example |
| No32 | U | 1230 | 880 | 530 | 90 | 740 | 6 | 2.0 | 0.18 | Example |
| No33 | V | 1230 | 860 | 550 | 90 | 750 | 6 | 2.0 | 0.18 | Comparative Example |

TABLE 3

| Steel Sheet Code | Steel Code | Tensile Strength MPa | Total Elongation % | Yield Elongation % | Ferrite Phase Fraction % | Second Phase Fraction % | Amount of Solid Solution N mass % | Evaluation of Formability | Note |
|---|---|---|---|---|---|---|---|---|---|
| No1 | A | 495 | 25 | 0.0 | 95.0 | 4.5 | <0.0001 | ◎ | Example |
| No2 | B | 510 | 24 | 0.0 | 95.0 | 5.0 | <0.0001 | ◎ | Example |
| No3 | C | 570 | 12 | 0.4 | 97.7 | 2.0 | <0.0001 | ◎ | Example |
| No4 | D | 580 | 14 | 1.1 | 90.0 | 9.5 | <0.0001 | ○ | Example |
| No5 | E | 490 | 26 | 2.0 | 96.6 | 3.0 | <0.0001 | ○ | Example |
| No6 | F | 550 | 22 | 0.0 | 94.0 | 6.0 | 0.0003 | ◎ | Example |
| No7 | G | 530 | 23 | 0.0 | 94.1 | 5.5 | <0.0001 | ◎ | Example |
| No8 | H | 570 | 25 | 0.0 | 92.0 | 8.0 | 0.0001 | ◎ | Example |
| No9 | I | 420 | 28 | 4.0 | 100.0 | 0.0 | <0.0001 | × | Comparative Example |
| No10 | J | 410 | 28 | 3.0 | 100.0 | 0.0 | <0.0001 | × | Comparative Example |
| No11 | K | 600 | 10 | 1.5 | 96.4 | 3.0 | 0.0005 | × | Comparative Example |
| No12 | L | 430 | 23 | 2.4 | 99.5 | 0.4 | 0.0002 | × | Comparative Example |
| No13 | M | 580 | 11 | 0.0 | 99.2 | 0.5 | <0.0001 | × | Comparative Example |
| No14 | N | 460 | 11 | 3.5 | 99.0 | 0.7 | <0.0001 | × | Comparative Example |
| No15 | O | 450 | 15 | 2.3 | 99.3 | 0.5 | 0.0002 | × | Comparative Example |
| No16 | A | 530 | 22 | 0.0 | 93.0 | 7.0 | <0.0001 | ◎ | Example |
| No17 | A | 535 | 23 | 0.0 | 92.0 | 7.6 | <0.0001 | ◎ | Example |
| No18 | A | 550 | 12 | 1.2 | 97.5 | 1.8 | <0.0001 | ○ | Example |
| No19 | A | 480 | 13 | 1.8 | 98.0 | 1.4 | <0.0001 | ○ | Example |
| No20 | A | 450 | 15 | 5.0 | 100.0 | 0.0 | <0.0001 | × | Comparative Example |
| No21 | A | 460 | 20 | 3.0 | 99.2 | 0.5 | <0.0001 | × | Comparative Example |
| No22 | A | 550 | 10 | 0.5 | 93.5 | 6.0 | <0.0001 | × | Comparative Example |
| No23 | A | 630 | 5 | 0.0 | 96.0 | 4.0 | <0.0001 | × | Comparative Example |
| No24 | A | 500 | 22 | 3.0 | 95.4 | 4.0 | <0.0001 | × | Comparative Example |
| No25 | A | 470 | 20 | 2.3 | 98.7 | 0.7 | <0.0001 | × | Comparative Example |
| No26 | A | 500 | 25 | 0.0 | 96.5 | 3.5 | 0.0002 | ◎ | Example |
| No27 | P | 465 | 24 | 5.3 | 99.2 | 0.4 | <0.0001 | × | Comparative Example |
| No28 | Q | 540 | 13 | 5.6 | 96.0 | 3.2 | 0.0028 | × | Comparative Example |
| No29 | R | 820 | 12 | 0.0 | 82.6 | 16.7 | <0.0001 | ◎ | Example |
| No30 | S | 760 | 12 | 0.0 | 81.6 | 17.5 | <0.0001 | ◎ | Example |
| No31 | T | 710 | 14 | 0.0 | 87.5 | 12.1 | <0.0001 | ◎ | Example |
| No32 | U | 740 | 13 | 0.0 | 80.3 | 19.2 | <0.0001 | ◎ | Example |
| No33 | V | 850 | 4 | 2.4 | 79.4 | 18.1 | <0.0001 | × | Comparative Example |

All the examples of the present invention had a tensile strength of 480 MPa or more, a total elongation of 12% or more, a yield elongation of 2.0% or less, a microstructure including a ferrite phase as a main phase in which the area fraction of a second phase was 1.0% or more, which means these examples were high-strength steel sheets for cans having high total elongation and low yield elongation. In addition, in all the examples of the present inventions, sufficient strength of can bottoms was achieved after can making had been performed.

On the other hand, the comparative examples were poor in terms of one or more of tensile strength, total elongation, yield elongation, and the area fraction of a second phase and had insufficient formability.

The invention claimed is:

1. A steel sheet for cans, the steel sheet having a chemical composition containing, by mass %, C: 0.015% or more and 0.150% or less, Si: 0.04% or less, Mn: 1.0% or more and 2.0% or less, P: 0.025% or less, S: 0.015% or less, Al: 0.01% or more and 0.10% or less, N: 0.0005% or more and less than 0.0050%, Ti: 0.003% or more and 0.015% or less, B: 0.0010% or more and 0.0040% or less, and the balance being Fe and inevitable impurities, a steel sheet microstructure including a ferrite phase as a main phase and at least one of a martensite phase and a retained austenite phase as a second phase, the total area fraction of the second phase being 1.0% or more, a tensile strength of 480 MPa or more, a total elongation of 12% or more, and a yield elongation of 2.0% or less, wherein the steel sheet is cooled at a cooling rate from an annealing temperature to a temperature of 400° C. at 2° C./s or more and less than 70° C./s in order to have excellent formability, and wherein by cutting a circle (size: 140 mmϕ) out of the steel sheet, by then performing, deep drawing, and ironing in order to make a can having a bottom and a circular cylindrical form (size: 50 mmϕ×100 mmH), by then performing bead forming on five positions in total in the circumferential direction of the can, that is, on the central position in the height direction of the can body, positions located 10 mm higher and lower, than the central position in the height direction, and positions located 20 mm higher and lower than the central position in the height direction, and by obtaining a can having a can body similar to that of a two-piece can, excellent formability exists when fracturing does not occur in the can body at the time of can making.

2. The steel sheet for cans according to claim 1, wherein the chemical composition further contains one or both of Cr: 0.03% or more and 0.30% or less and Mo: 0.01% or more and 0.10% or less.

3. A method for manufacturing the steel sheet for cans according to claim 1, the method comprising heating a slab having the chemical composition according to claim 1 to a heating temperature of 1130° C. or higher, hot-rolling the heated slab with a finishing temperature of 820° C. or higher and 930° C. or lower, then coiling the hot-rolled steel sheet at a coiling temperature of 640° C. or lower, pickling the coiled steel sheet, performing primary cold rolling on the pickled steel sheet with a rolling reduction of 85% or more, performing continuous annealing on the cold-rolled steel sheet at an annealing temperature of 720° C. or higher and 780° C. or lower, and performing secondary cold rolling with a rolling reduction of 1.0% or more and 10% or less.

4. The method for manufacturing the steel sheet for cans according to claim 3, the method further comprising, after the continuous annealing has been performed, cooling the annealed steel sheet from the annealing temperature to a temperature of 400° C. at a cooling rate of 2° C./s or more and less than 70° C./s and then performing the secondary cold rolling.

5. The method for manufacturing the steel sheet for cans according to claim 3, wherein the chemical composition further contains one or both of Cr:

0.03% or more and 0.30% or less and Mo: 0.01% or more and 0.10% or less.

6. The method for manufacturing the steel sheet for cans according to claim 5, the method further comprising, after the continuous annealing has been performed, cooling the annealed steel sheet from the annealing temperature to a temperature of 400° C. at a cooling rate of 2° C./s or more and less than 70° C./s and then performing the secondary cold rolling.

* * * * *